US010320099B2

(12) United States Patent
Smith, Jr. et al.

(10) Patent No.: US 10,320,099 B2
(45) Date of Patent: Jun. 11, 2019

(54) CONNECTOR WITH ASYMMETRIC BASE SECTION

(71) Applicant: TE Connectivity Corporation, Berwyn, PA (US)

(72) Inventors: Graham Harry Smith, Jr., Mechanicsburg, PA (US); Scott Eric Walton, Mount Joy, PA (US); Albert Tsang, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 5 days.

(21) Appl. No.: 15/617,711

(22) Filed: Jun. 8, 2017

(65) Prior Publication Data

US 2017/0358876 A1 Dec. 14, 2017

Related U.S. Application Data

(60) Provisional application No. 62/348,651, filed on Jun. 10, 2016.

(51) Int. Cl.
*H01R 13/42* (2006.01)
*H01R 12/58* (2011.01)
(Continued)

(52) U.S. Cl.
CPC ..... *H01R 12/585* (2013.01); *H01R 12/721* (2013.01); *H01R 13/41* (2013.01); *H01R 13/6461* (2013.01); *H01R 31/005* (2013.01)

(58) Field of Classification Search
CPC ..... H01R 12/585; H01R 12/58; H01R 13/05; H01R 13/422
(Continued)

(56) References Cited

U.S. PATENT DOCUMENTS 3,223,960 A 12/1965 Ruehlemann
4,036,549 A * 7/1977 Honda ..... H01R 4/26 439/722
(Continued)

FOREIGN PATENT DOCUMENTS

DE 10 2007 002 202 A1 8/2007
EP 0 806 814 A2 11/1997
(Continued)

OTHER PUBLICATIONS

International Search Report, Application No. PCT/IB2017/053437, International Filing Date, Jun. 9, 2017.

*Primary Examiner* — Hae Moon Hyeon

(57) ABSTRACT

An electrical contact includes a base that includes first and second side edges, and a forward edge that extends between the first and second side edges. At least one contact arm extends from the forward edge of the base for making electrical contact with a contact pad. Each of the first and second side edges defines one or more protrusions configured to engage an interior portion of a connector housing for securing the electrical contact within the connector housing. The one or more protrusions on the first side edge are asymmetrically arranged with respect to the one or more protrusions on the second side edge such that respective centers of each of the one or more protrusions on the first side edge are misaligned with respective centers of each of the one or more protrusions on the second side edge.

12 Claims, 8 Drawing Sheets

(51) Int. Cl.

| | |
|---|---|
| ***H01R 12/72*** | (2011.01) |
| ***H01R 13/41*** | (2006.01) |
| ***H01R 13/6461*** | (2011.01) |
| ***H01R 31/00*** | (2006.01) |

(58) Field of Classification Search
USPC ..... 439/751
See application file for complete search history.

(56) References Cited

U.S. PATENT DOCUMENTS

| | | | | |
|---|---|---|---|---|
| 4,188,715 | A * | 2/1980 | Ammon | H01R 12/585 29/884 |
| 4,464,007 | A * | 8/1984 | Parmer | H01R 12/585 439/389 |
| 5,093,640 | A | 3/1992 | Bischof | |
| 6,171,115 | B1 | 1/2001 | Mickievicz et al. | |
| 6,267,604 | B1 | 7/2001 | Mickievicz et al. | |
| 6,379,188 | B1 | 4/2002 | Cohen et al. | |
| 6,655,966 | B2 | 12/2003 | Rothermel et al. | |
| 6,663,442 | B1 | 12/2003 | Helster et al. | |
| 6,811,440 | B1 | 11/2004 | Rothermel et al. | |
| 6,824,391 | B2 | 11/2004 | Mickievicz et al. | |
| 7,044,794 | B2 | 5/2006 | Consoli et al. | |
| 7,175,445 | B2 | 2/2007 | Consoli et al. | |
| 7,326,092 | B2 | 2/2008 | Fedder et al. | |
| 8,550,861 | B2 | 10/2013 | Cohen et al. | |
| 8,727,791 | B2 | 5/2014 | Gulla | |
| 9,017,114 | B2 | 4/2015 | Cohen et al. | |
| 9,033,750 | B2 * | 5/2015 | Miller | H01R 13/26 439/862 |
| 9,173,292 | B1 | 10/2015 | Sokol et al. | |
| 9,190,745 | B2 | 11/2015 | Gulla | |
| 2004/0180562 | A1 | 9/2004 | Raistrick et al. | |
| 2006/0014433 | A1 | 1/2006 | Consoli et al. | |
| 2006/0172566 | A1 | 8/2006 | Nakajima et al. | |
| 2009/0233459 | A1 | 9/2009 | Shiramizu et al. | |
| 2010/0096165 | A1 | 4/2010 | Lo et al. | |
| 2014/0051294 | A1 * | 2/2014 | Miller | H01R 13/26 439/625 |
| 2014/0308852 | A1 | 10/2014 | Gulla | |
| 2014/0329414 | A1 | 11/2014 | Cohen et al. | |
| 2015/0049444 | A1 | 2/2015 | Venk et al. | |
| 2015/0129284 | A1 | 5/2015 | Aparimarn et al. | |
| 2015/0359082 | A1 | 12/2015 | Nishimura et al. | |
| 2017/0054233 | A1 * | 2/2017 | Kikuchi | H01R 12/585 |

FOREIGN PATENT DOCUMENTS

| | | | |
|---|---|---|---|
| EP | 1 545 170 | A1 | 12/2004 |
| EP | 1 940 207 | A2 | 7/2008 |
| EP | 2 091 307 | A1 | 8/2009 |
| EP | 2 775 732 | A1 | 10/2014 |
| WO | 2015 029942 | A1 | 3/2015 |

* cited by examiner

CONNECTOR WITH ASYMMETRIC BASE SECTION

RELATED APPLICATIONS

This application claims the benefit of priority to U.S. Provisional Application No. 62/348,651, filed Jun. 10, 2016, the content of which is hereby incorporated by reference in its entirety.

BACKGROUND

I. Field

The present invention relates generally to electrical connectors. More specifically, the present invention relates to a connector with an asymmetric base section.

II. Description of Related Art

Some electrical systems incorporate a number of electrical modules that are interconnected with one another via a backplane circuit board. Connectors on the modules facilitate insertion of the modules into complementary connectors on the backplane.

Each connector may be configured to couple one or more signals between the electrical module and the backplane. Signals transferred via the connector may be relatively high-frequency signals. Special care must be taken in the construction of the connector to minimize degradation of any signals communicated over the connector.

SUMMARY

In one aspect, an electrical contact includes a base that includes first and second side edges, and a forward edge that extends between the first and second side edges. At least one contact arm extends from the forward edge of the base for making electrical contact with a contact pad. Each of the first and second side edges defines one or more protrusions configured to engage an interior portion of a connector housing for securing the electrical contact within the connector housing. The one or more protrusions on the first side edge are asymmetrically arranged with respect to the one or more protrusions on the second side edge, such that respective centers of each of the one or more protrusions on the first side edge are misaligned with respective centers of each of the one or more protrusions on the second side edge.

In a second aspect, an electrical connector assembly includes a first connector and a second connector configured to be mated to the first connector. The second connector includes a plurality of electrical contacts. At least some of the electrical contacts include first and second side edges, and a forward edge that extends between the first and second side edges. At least one contact arm extends from the forward edge of the base for making electrical contact with a contact pad. Each of the first and second side edges defines one or more protrusions configured to engage an interior portion of a connector housing for securing the electrical contact within the connector housing. The one or more protrusions on the first side edge are asymmetrically arranged with respect to the one or more protrusions on the second side edge, such that respective centers of each of the one or more protrusions on the first side edge are misaligned with respective centers of each of the one or more protrusions on the second side edge.

In a third aspect, an electrical product includes an electrical connector assembly. The electrical connector assembly includes a first connector and a second connector configured to be mated to the first connector. The second connector includes a plurality of electrical contacts. At least some of the electrical contacts include first and second side edges, and a forward edge that extends between the first and second side edges. At least one contact arm extends from the forward edge of the base for making electrical contact with a contact pad. Each of the first and second side edges defines one or more protrusions configured to engage an interior portion of a connector housing for securing the electrical contact within the connector housing. The one or more protrusions on the first side edge are asymmetrically arranged with respect to the one or more protrusions on the second side edge, such that respective centers of each of the one or more protrusions on the first side edge are misaligned with respective centers of each of the one or more protrusions on the second side edge.

DETAILED DESCRIPTION

Figure 1:
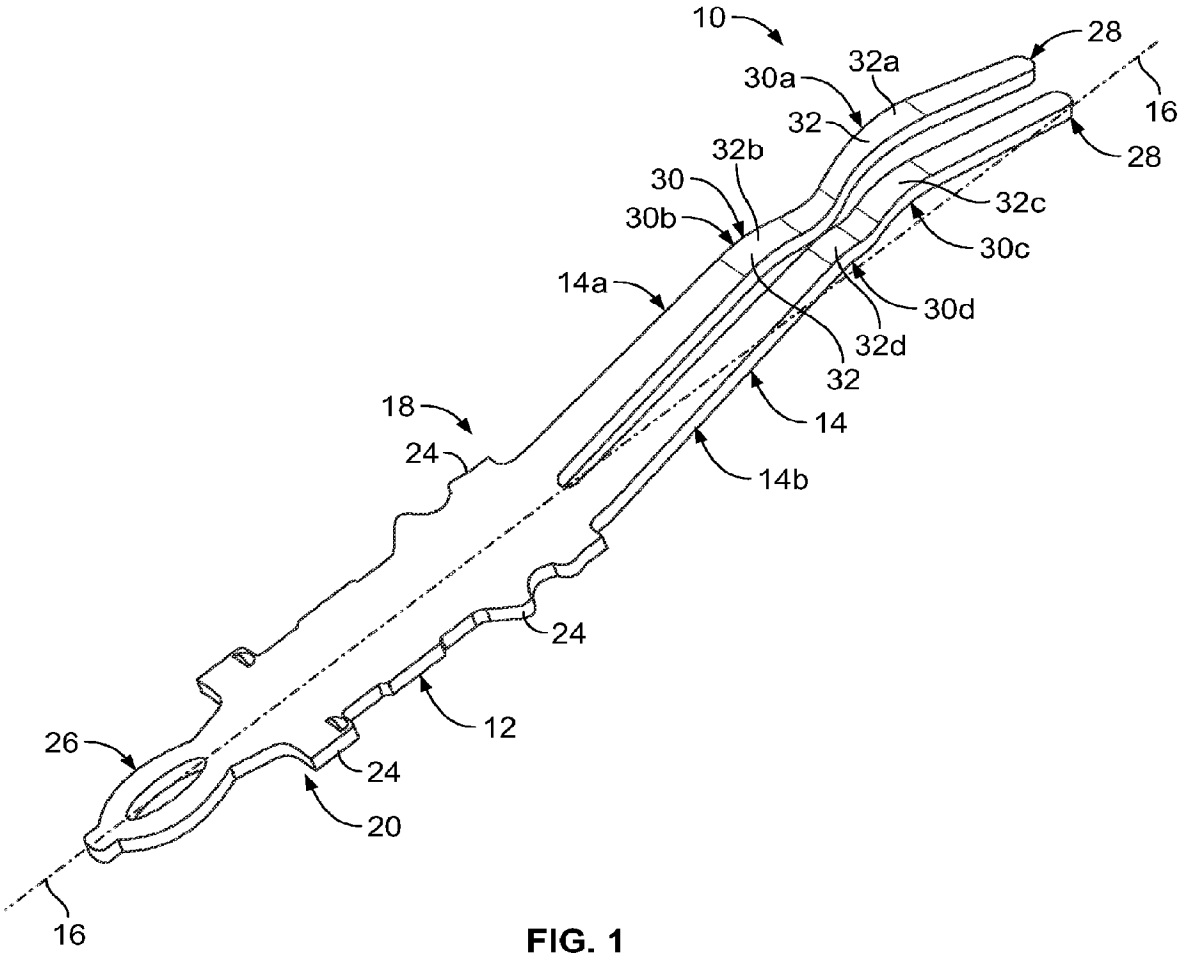
FIG. 1 is a perspective view of an exemplary embodiment of an electrical contact.
Figure 11:
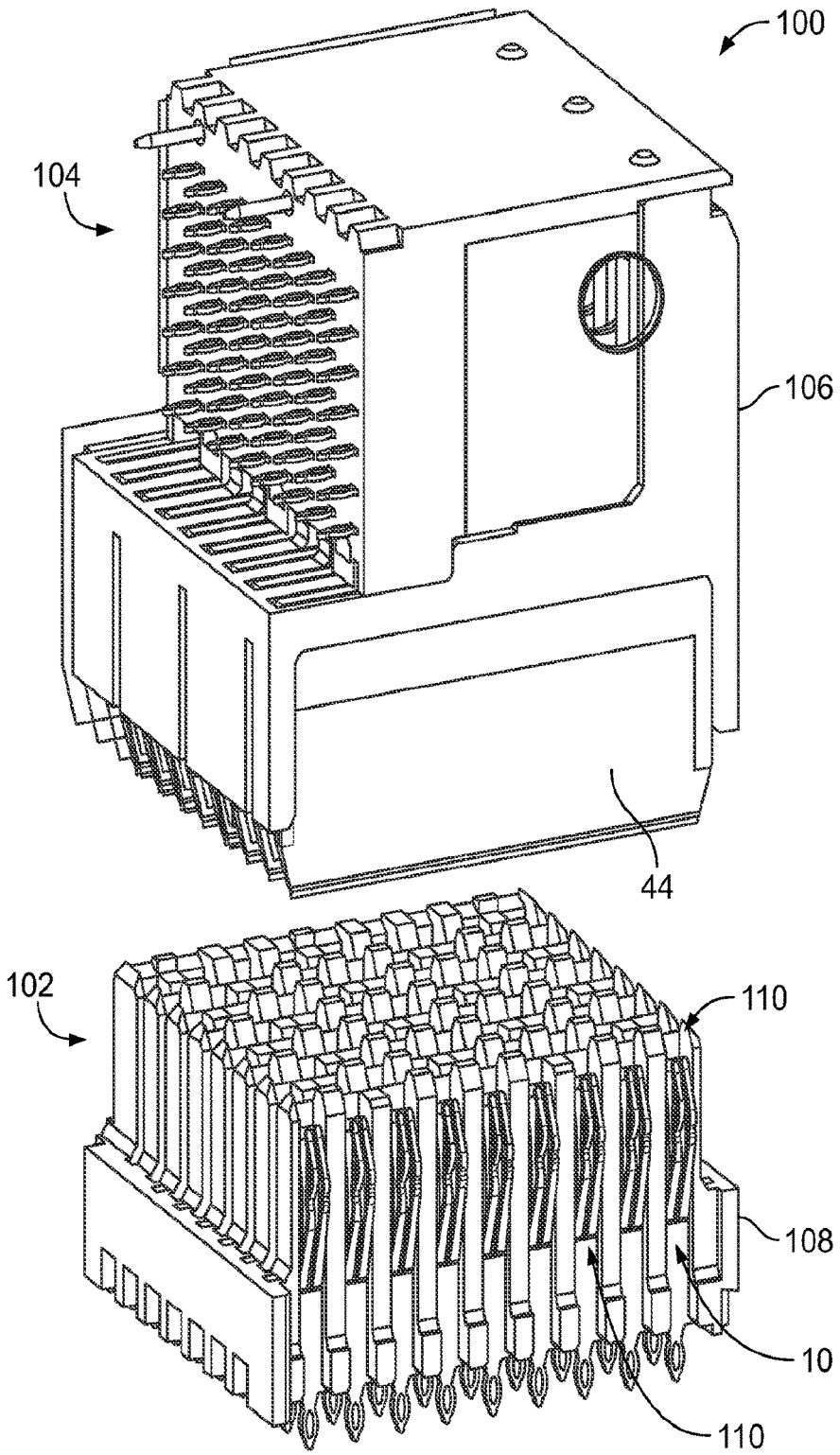
FIG. 11 is perspective view of an electrical connector assembly.

FIG. 1 is a perspective view of an exemplary embodiment of an electrical contact 10 that may be an integral component of an electrical connector assembly 100, as illustrated in FIG. 11. The electrical connector assembly 100 may be one of many disposed on a specialized circuit module to facilitate electrically coupling signals on the circuit module with other circuit modules via a back plane circuit board of a product such radio frequency (RF) test equipment and the like.

The electrical contact 10 includes a base 12 and one or more arms 14 that extend from the base 12. The base 12 extends a length along a central longitudinal axis 16 of the base 12. In the exemplary embodiment, the base 12 extends the length from an arm end 18 of the base 12 to a mounting end 20 of the base 12. The arms 14 extend outwardly from the arm end 18 of the base 12. As will be described in more detail below, the arms 14 are configured to mate with a mating contact 22 (FIGS. 6-9) to establish an electrical connection between the electrical contact 10 and the mating contact 22.

The base 12 may include one or more mounting structures for mounting the base 12 within a housing (e.g., the housing 108 shown in FIG. 11) of an electrical connector (e.g., the electrical connector 102 shown in FIG. 11). In the exemplary embodiment, the base 12 includes interference tabs 24 that are configured to engage the housing with an interference-fit to hold the base 12 within the housing. Other structures (e.g., snap-fit structures, latches, fasteners, and/or the like) may be used in addition or alternative to the interference tabs 24 to hold the base 12 within an electrical connector housing.

In the exemplary embodiment, the electrical contact 10 includes a mounting segment 26 that extends from the mounting end 20 of the base 12. The mounting segment 26 is configured to mount the electrical contact 10 to a circuit board (not shown). Alternatively, the electrical contact 10 is configured to terminate the end (not shown) of an electrical cable (not shown) at the mounting end 20 of the base 12 or is configured to mate with another mating contact (not shown) at the mounting end 20 of the base 12 (i.e., in addition to mating with the mating contact 22 at the arms 14). In the exemplary embodiment, the mounting segment 26 is an eye-of-the needle press-fit pin that is configured to be press fit into an electrical via (not shown) of the circuit board. But the mounting segment 26 may additionally or alternatively include any other structure for mounting the electrical contact 10 to the circuit board such as, but not limited to, solder tail, a surface mount pad (whether or not solder is used), another type of press-fit pin, and/or the like. Although the length of the base 12 is shown as being approximately straight, alternatively the length of the base 12 includes one or more bends such as, but not limited to, an approximately 90° bend and/or the like). For example, in some embodiments, the base 12 includes an approximately 90° bend such that the electrical contact 10 is a right-angle contact designed for use within an orthogonal electrical connector.

The electrical contact 10 may include any number of the arms 14. In the exemplary embodiment, the electrical contact 10 has a fork-like structure that includes two of the arms 14, namely the arms 14*a* and 14*b*. Each of the arms 14*a* and 14*b* extends a length outwardly from the base 12 along the central longitudinal axis 16 of the base 12. In the exemplary embodiment, the arms 14 extend the lengths outwardly from the arm end 18 of the base 12 to free ends 28 of the arms 14, as can be seen in FIG. 1. Alternatively, the end 28 of one or more of the arms 14 is not free, but rather is connected to another structure such as, but not limited to, the end 28 of another arm 14. The arms 14*a* and 14*b* may each be referred to herein as a "first" arm and/or a "second" arm.

Each of the arms 14*a* and 14*b* includes one or more mating bumps 30 at which the arm 14 mates with the mating contact 22. In the exemplary embodiment, the arm 14*a* includes two mating bumps 30*a* and 30*b*, and the arm 14*b* includes two mating bumps 30*e* and 30*d*. But the arm 14*a* may include any number of the mating bumps 30, and the arm 14*b* may include any number of the mating bumps 30 (whether or not the number of mating bumps 30 of the arm 14*b* is the same as the number of mating bumps 30 of the arm 14*a*). Each of the mating bumps 30*a*, 30*b*, 30*e*, and 30*d* may be referred to herein as a "first" mating bump and/or a "second" mating bump.

Each mating bump 30 includes a mating surface 32. Specifically, the mating bumps 30*a*, 30*b*, 30*e*, and 30*d* include respective mating surfaces 32*a*, 32*b*, 32*e*, and 32*d*. Each mating bump 30 engages the mating contact 22 at the mating surface 32 thereof to establish an electrical connection with the mating contact 22. Each of the mating surfaces 32*a*, 32*b*, 32*e*, and 32*d* may be referred to herein as a "first" mating surface and/or a "second" mating surface. In the exemplary embodiment, the mating contact 22 is a contact pad of a circuit board 44 (FIGS. 6-9) and the mating bumps 30 and the mating surfaces 32 are configured to mate with the contact pad. Alternatively, the mating bumps 30 and the mating surfaces 32 are configured to mate with another type of mating contact such as, but not limited to, a blade, a bar, an arm, a spring, and/or the like.

The electrical contact 10 may be fabricated from (i.e., include) any electrically conductive material such as, but not limited to, copper, nickel, gold, silver, aluminum, tin, and/or the like. In some embodiments, at least a portion of the electrical contact 10 (e.g., the arms 14*a* and/or 14*b*, the base 12, the mounting segment 26, the mating bumps 30*a*, 30*b*, 30*e*, and/or 30*d*, portions thereof, and/or the like) includes a base material that is coated with an electrically conductive surface coating (e.g., a plating and/or the like). The electrically conductive surface coating may be fabricated from any electrically conductive material such as, but not limited to, copper, nickel, gold, silver, aluminum, tin, and/or the like.

Figure 2:
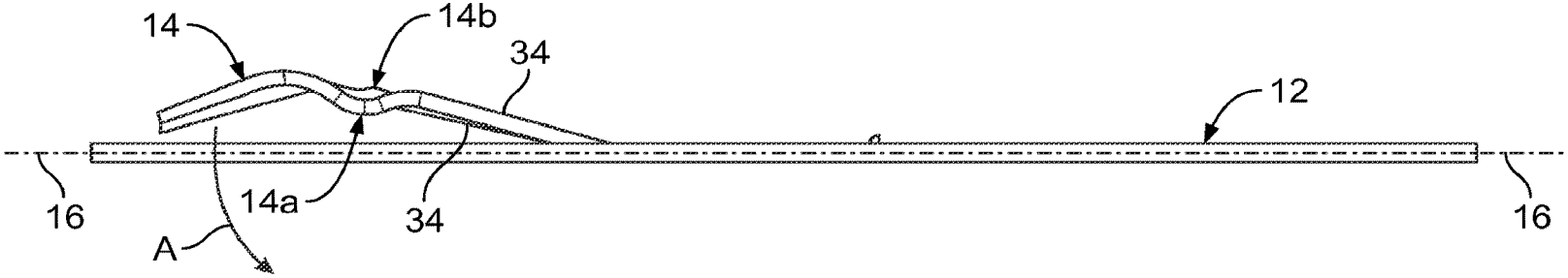
FIG. 2 is side elevational view of the electrical contact.

FIG. 2 is side elevational view of the electrical contact 10. As can be seen in FIG. 2, in the exemplary embodiment, the arms 14*a* and 14*b* each extend outwardly from the base 12 at a non-parallel angle relative to the central longitudinal axis 16 of the base 12. Specifically, a base segment 34 of each of the arms 14*a* and 14*b* extends outwardly from the base 12 at the non-parallel angle relative to the central longitudinal axis 16. In some alternative embodiments, the base segment 34 of the arm 14*a* and/or the arm 14*b* extends outwardly from the base 12 at an approximately parallel angle relative to the central longitudinal axis 16 of the base 12. The base segment 34 of each arm 14 may extend outwardly from the base 12 at any angle relative to the central longitudinal axis 16 of the base 12.

Optionally, one or more of the arms 14 is a spring that is configured to be resiliently deflected from a resting position when the arm 14 is mated with the mating contact 22. In the exemplary embodiment, each of the arms 14*a* and 14*b* is a resiliently deflectable spring. The arms 14*a* and 14*b* are shown in the resting positions in FIG. 2. As the arms 14*a* and 14*b* engage the mating contact 22, the arms 14*a* and 14*b* are resiliently deflected along an arc A from the resting positions shown in FIG. 2 to deflected positions, which are shown in FIGS. 7 and 8, respectively. Each arm 14 may deflect by any amount along the arc A.

Figure 3:
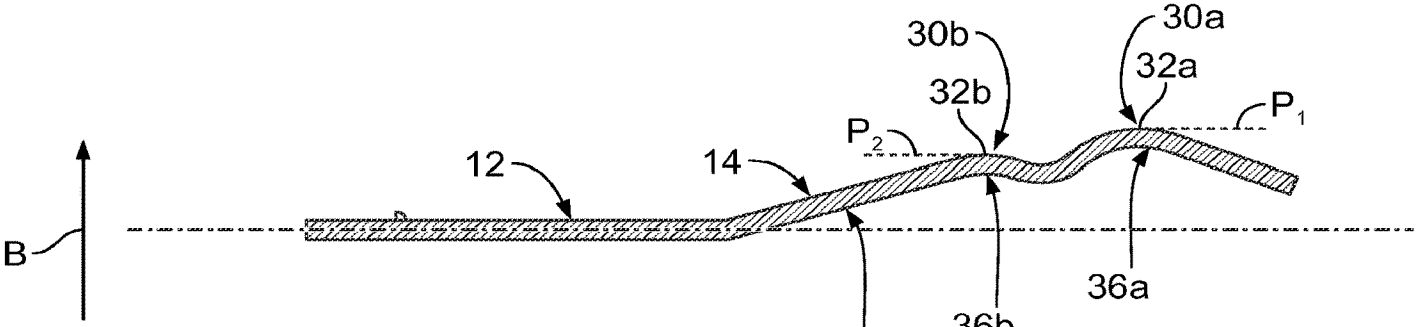
FIG. 3 is a cross-sectional view of the electrical contact.

FIG. 3 is a cross-sectional view of the electrical contact 10 illustrating the arm 14*a*. The arm 14*a* is shown in the resting position in FIG. 3. Referring now to FIGS. 1 and 3, the arm 14*a* includes the mating bumps 30*a* and 30*b*, which include the respective mating surfaces 32*a* and 32*b*. The mating surface 32*a* of the mating bump 30*a* is spaced apart along the length of the arm 14*a* from the mating surface 32*b* of the mating bump 30*a*. In other words, the mating surface 32*a* of the mating bump 30*a* is staggered along the length of the arm 14*a* relative to the mating surface 32*b* of the mating bump 30*b*, such that the mating surfaces 32*a* and 32*b* have different axial locations along the central longitudinal axis 16 of the base 12. The mating surfaces 32*a* and 32*b* may be spaced apart along the length of the arm 14*a* by any amount.

Referring now solely to FIG. 3, optionally, the mating surfaces 32*a* and 32*b* of the respective mating bumps 30*a* and 30*b* are offset from the central longitudinal axis 16 of the base 12 in the direction of the arrow B when the arm 14*a* is in the resting position. The mating surfaces 32*a* and 32*b* are optionally offset from the central longitudinal axis 16 of the base 12 in the direction of the arrow B by different amounts when the arm 14*a* is in the resting position, as is shown in the exemplary embodiment. In other words, when the arm 14*a* is in the resting position, the mating surfaces 32*a* and 32*b* extend within respective planes PI and P2 that extend approximately parallel to the central longitudinal axis 16, wherein the planes PI and P2 are offset from the central longitudinal axis 16 in the direction of the arrow B by different amounts. Each of the mating surfaces 32*a* and 32*b* may be offset from the central longitudinal axis 16 in the direction of the arrow B by any amount when the arm 14*a* is in the resting position. Moreover, the difference between the offsets of the mating surfaces 32*a* and 32*b* from the central longitudinal axis 16 in the direction of the arrow B when the arm 14*a* is in the resting position may be any amount.

As can be seen in FIG. 3, in the exemplary embodiment, each of the mating bumps 30*a* and 30*b* of the arm 14*a* is defined by a respective bend 36*a* and 36*b* in the arm 14*a*. But the mating bumps 30*a* and 30*b* are not limited to being defined by a bend of the arm 14*a*. Rather, in alternative to being defined by a bend, each of the mating bumps 30*a* and 30*b* may be defined by another structure such as, but not limited to, a segment of increased thickness and/or the like.

Figure 4:
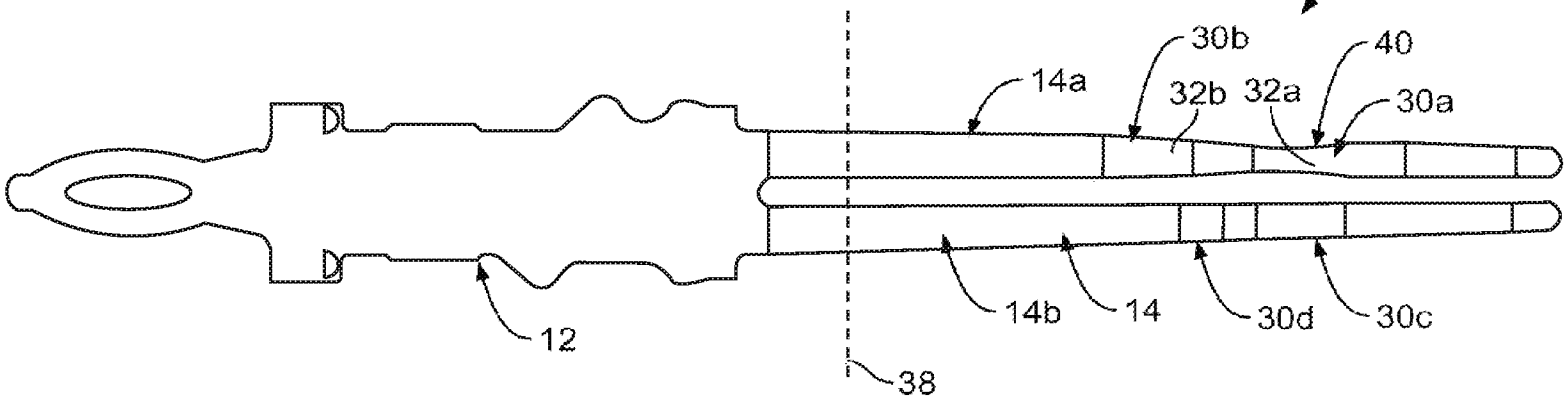
FIG. 4 is a plan view of the electrical contact.

FIG. 4 is a plan view of the electrical contact 10. The arm 14*a* extends a width along a width axis 38 that extends approximately perpendicular to the central longitudinal axis 16 of the base 12. Optionally, the arm 14*a* includes a necked-down segment 40 wherein the width of the arm 14*a* is reduced as compared to adjacent axial locations along the length of the arm 14*a*. The necked-down segment optionally extends at approximately the same axial location along the length of the arm 14*a* (i.e., along the central longitudinal axis 16) as the mating bump 30*a*, as is shown in the exemplary embodiment. In some alternative embodiments, the necked-down segment 40 extends at approximately the same axial location along the length of the arm 14*a* as the mating bump 30*b* instead of as the mating bump 30*a*. Moreover, in some alternative embodiments, the arm 14*a* includes a necked-down segment 40 at both of the mating bumps 30*a* and 30*b*. The arm 14*a* may include any number of necked-down segments 40, each of which may have any axial location along the length of the arm 14*a* and may have a width that is reduced by any amount. Although not shown, in some embodiments, the arm 14*b* includes one or more necked-down segments (not shown) wherein the width of the arm 14*b* is reduced as compared to adjacent axial locations along the length of the arm 14*b*. In some embodiments, a necked-down segment of the arm 14*b* extends at a different axial location along the central longitudinal axis 16 than one or more of the necked-down segments 40 of the arm 14*a*, and/or vice versa. In the exemplary embodiment, the arms 14*a* and 14*b* have the same length as each other, as is shown in FIG. 4. But the arms 14*a* and 14*b* may have different lengths than each other. In embodiments wherein the arms 14*a* and 14*b* have different lengths, the arm 14*a* may be longer than the arm 14*b*, or vice versa.

Referring now to FIGS. 1, 3, and 4, the positions, orientations, dimensions, and/or the like of the arm 14*a* and the various components of the arm 14*a* (e.g., the base segment 34, the necked-down segment(s) 40, the mating bumps 30*a* and 30*b*, the mating surfaces 32*a* and 32*b*, and/or the like) provide the arm 14*a* with a predetermined geometry. In other words, the arm 14*a* includes the predetermined geometry. The pre-determined geometry of the arm 14*a* provides the arm 14*a* with a predetermined response to vibration. In other words, the predetermined geometry of the arm 14*a* provides the arm 14*a* with a predetermined response to vibrational forces experienced by the arm 14*a*. For example, the predetermined geometry of the arm 14*a* provides the arm 14*a* with a predetermined natural (i.e., resonant) frequency and/or a predetermined response to forced vibration. The terms "response to vibration" and "vibrational response" are used interchangeably herein. The vibrational response of the arm 14*a* may be referred to herein as a "first" vibrational response and/or a "second" vibrational response.

Figure 5:
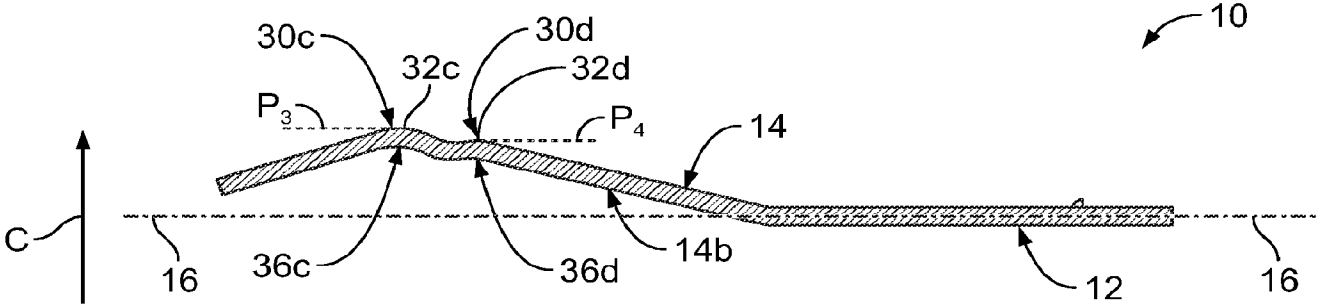
FIG. 5 is a cross-sectional view of the electrical contact.

FIG. 5 is a cross-sectional view of the electrical contact 10 illustrating the arm 14*b*. The arm 14*b* is shown in the resting position in FIG. 5. Referring now to FIGS. 1 and 5, the arm 14*b* includes the mating bumps 30*e* and 30*d*, which include the respective mating surfaces 32*e* and 32*d*. The mating surface 32*e* of the mating bump 30*e* is spaced apart along the length of the arm 14*b* from the mating surface 32*d* of the mating bump 30*d*. In other words, the mating surface 32*e* of the mating bump 30*e* is staggered along the length of the arm 14*b* relative to the mating surface 32*d* of the mating bump 30*d* such that the mating surfaces 32*e* and 32*d* have different axial locations along the central longitudinal axis 16 of the base 12. The mating surfaces 32*e* and 32*d* may be spaced apart along the length of the arm 14*b* by any amount.

Referring now solely to FIG. 5, optionally, the mating surfaces 32*e* and 32*d* of the respective mating bumps 30*e* and 30*d* are offset from the central longitudinal axis 16 of the base 12 in the direction of the arrow C when the arm 14*b* is in the resting position. As shown in the exemplary embodiment, the mating surfaces 32*e* and 32*d* are optionally offset from the central longitudinal axis 16 of the base 12 in the direction of the arrow C by different amounts when the arm 14*b* is in the resting position. In other words, when the arm 14*b* is in the resting position, the mating surfaces 32*e* and 32*d* extend within respective planes P3 and P4 that extend approximately parallel to the central longitudinal axis 16, wherein the planes P3 and P4 are offset from the central longitudinal axis 16 in the direction of the arrow C by different amounts. Each of the mating surfaces 32*e* and 32*d* may be offset from the central longitudinal axis 16 in the direction of the arrow C by any amount when the arm 14*a* is in the resting position. Moreover, the difference between the offsets of the mating surfaces 32*e* and 32*d* from the central longitudinal axis 16 in the direction of the arrow C when the arm 14*b* is in the resting position may be any amount.

In the exemplary embodiment, each of the mating bumps 30*e* and 30*d* of the arm 14*b* is defined by a respective bend 36*e* and 36*d* in the arm 14*b*. But the mating bumps 30*e* and 30*d* are not limited to being defined by a bend of the arm 14*b*. Rather, in alternative to being defined by a bend, each of the mating bumps 30*e* and 30*d* may be defined by another structure such as, but not limited to, a segment of increased thickness and/or the like.

Referring now to FIGS. 1, 4, and 5, the positions, orientations, dimensions, and/or the like of the arm 14*b* and the various components of the arm 14*b* (e.g., the base segment 34, any necked-down segments, the mating bumps 30*e* and 30*d*, the mating surfaces 32*e* and 32*d*, and/or the like) provide the arm 14*b* with a predetermined geometry. In other words, the arm 14*b* includes the predetermined geometry. The predetermined geometry of the arm 14*b* provides the arm 14*b* with a predetermined response to vibration. In other words, the pre-determined geometry of the arm 14*b* provides the arm 14*b* with a predetermined response to vibrational forces experienced by the arm 14*b*. For example, the predetermined geometry of the arm 14*b* provides the arm 14*b* with a predetermined natural (i.e., resonant) frequency and/or a predetermined response to forced vibration. The vibrational response of the arm 14*b* may be referred to herein as a "first" vibrational response and/or a "second" vibrational response.

Referring now solely to FIG. 4, the mating bump 30*e* and/or the mating bump 30*d* of the arm 14*b* may have a different axial location along the central longitudinal axis 16 of the base 12 than the both of the mating bumps 30*a* and 30*b* of the arm 14*a*, and/or vice versa. For example, in the exemplary embodiment, each of the mating bumps 30*e* and 30*d* of the arm 14*b* has a different axial location along the central longitudinal axis 16 of the base 12 than the both of the mating bumps 30*a* and 30*b* of the arm 14*a*. In the exemplary embodiment, the mating bumps 30*a* and 30*b* of the arm 14*a* are spaced further apart from each other along the central longitudinal axis 16 than the mating bumps 30*e* and 30*d* are spaced apart from each other along the central longitudinal axis 16. Alternatively, the mating bumps 30*e* and 30*d* of the arm 14*b* are spaced further apart from each other along the central longitudinal axis 16 than the mating bumps 30*a* and 30*b* are spaced apart from each other along the central longitudinal axis 16. In another alternative embodiment, the mating bumps 30*a* and 30*b* of the arm 14*a* are spaced apart from each other along the central longitudinal axis 16 by approximately the same amount as the mating bumps 30*e* and 30*d* are spaced apart from each other along the central longitudinal axis 16.

The different axial locations of the mating bumps 30 and the spacing between the mating bumps 30 is selected to provide the arms 14*a* and 14*b* with different predetermined geometries. In addition or alternatively to the different spacings and/or axial locations, the positions, orientations, dimensions (e.g., the lengths, widths, and/or the like), and/or the like of the arms 14*a* and/or 14*b* and/or other various components of the arms 14*a* and/or 14*b* (e.g., the base segment 34, any necked-down segments, and/or the like) may provide the arms 14*a* and 14*b* with the different predetermined geometries.

The different predetermined geometries of the arms 14*a* and 14*b* provide the arms 14*a* and 14*b* with different predetermined vibrational responses than each other. In other words, the arms 14*a* and 14*b* will vibrate differently (e.g., at different frequencies and/or the like) than each other in response to the same vibrational force exerted on the arms 14*a* and 14*b*. For example, the arms 14*a* and 14*b* may have different natural frequencies and/or the arms 14*a* and 14*b* may vibrate differently in response to the same forced vibration exerted on the arms 14*a* and 14*b*. It should be understood that in embodiments wherein the electrical contact 10 includes more than two of the arms 14, each arm 14 may be provided with a different vibrational response than each other or at least one of the arms 14 may have the same vibrational response as at least one other arm 14.

Figure 6B:
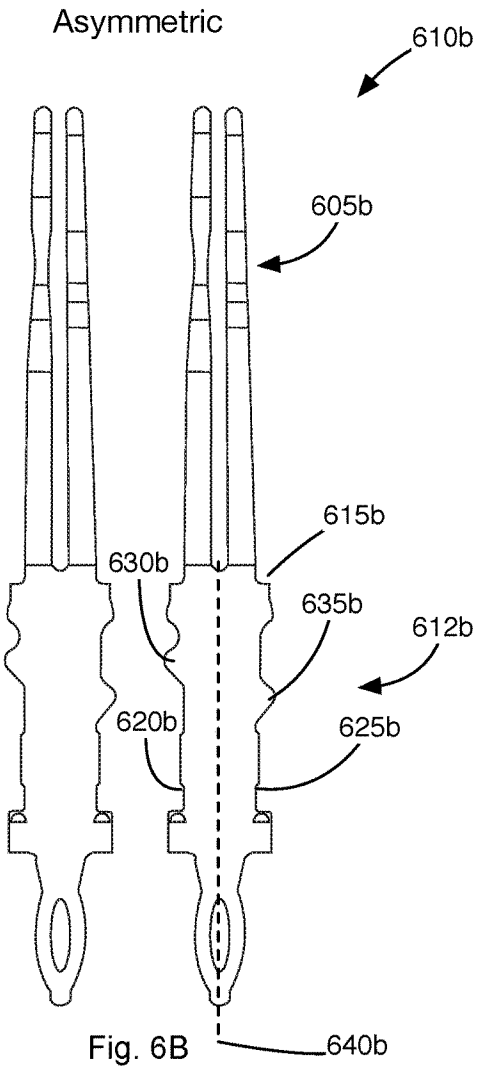
FIG. 6B illustrates a pair of electrical contacts having base sections having protrusions arranged asymmetrically about a center axis of the base sections.
Figure 6A:
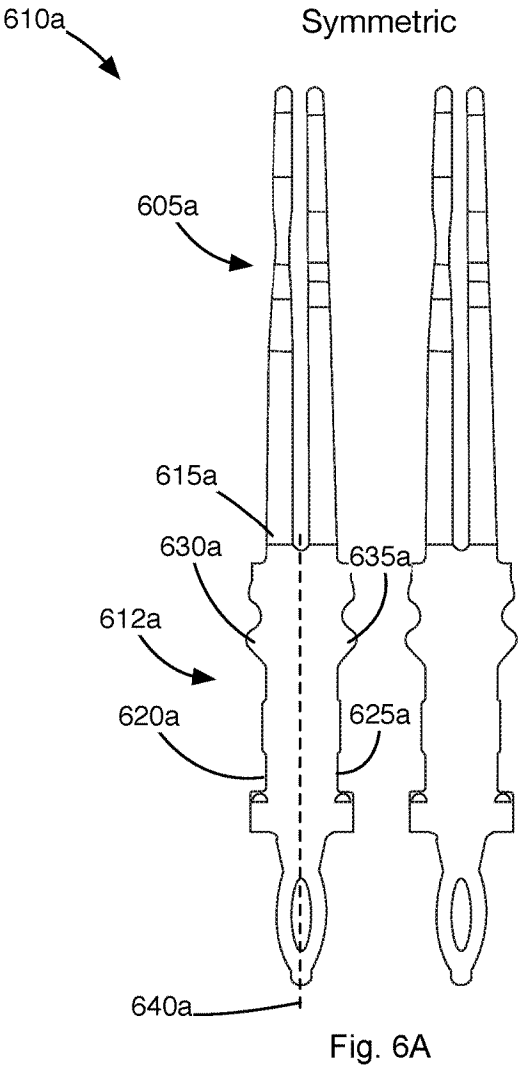
FIG. 6A illustrates a pair of electrical contacts having base sections having protrusions arranged symmetrically about a center axis of the base section.

FIGS. 6A and 6B illustrate exemplary bases 612*a,b* which may form part of electrical contacts 610*a,b*, respectively. The bases 612*a,b* and electrical contacts 610*a,b* may correspond to the base 12 and electrical contact 10 described above. The contact arms 605*a,b* (i.e., arms 14) extend from the forward edges 615*a,b* of respective bases 612*a,b* for making electrical contact with a contact pad (not shown).

Each base 612*a,b* includes first and second side edges 620*a,b* and 625*a,b*. The forward edges 615*a,b* extend between respective first and second side edges 620*a,b* and 625*a,b*.

Each of the first and second side edges 620*a,b* and 625*a,b* defines one or more protrusions 630*a,b* and 635*a,b* (i.e., interference tabs 24) configured to engage an interior portion of a housing for securing the electrical contacts 610*a,b* within the housing.

In FIG. 6*a*, the protrusions 630*a*, 635*a* are symmetrically arranged about the center axis 640*a* of the base 612*a*. Symmetrical placement of the protrusions 630*a*, 635*a* may be desired to avoid twisting of the electrical contacts 610*a* when inserting the electrical contacts 610*a* into a housing. As illustrated FIG. 6A, when two electrical contacts 610*a* are arranged side-by-side, the distance between facing edges of the electrical contacts 610*a* are significantly closer in the regions of the protrusions 630*a*, 635*a* than in other regions of the facing edges. The symmetrical arrangement of the protrusions 630*a*, 635*a* not only places a limitation on how close the electrical contacts 610*a* can be placed next to each other, but the closeness of the protrusions 630*a*, 635*a* reduces the impedance between the electrical contacts 610*a* near the protrusions 630*a*, 635*a* which results in a relatively inconsistent impedance along the length of the electrical contacts 610*a*. This in turn limits the high-frequency performance characteristics of the connector in which the electrical contacts 610*a* may be arranged.

In FIG. 6B, the protrusions 630*b*, 635*b* are asymmetrically arranged about the center axis 640*b* of the base 612*b*. Thus, when two electrical contacts 610*b* are arranged side-by-side as illustrated in FIG. 6B, the distance between a point on an edge of a first electrical contact 610*b* and a point on the edge opposite the first edge of the second electrical contact 610*b* is more consistent/uniform along the edge, between the forward edge of the base and the edge opposite the forward edge. This in turn results in a more uniform impedance between the electrical contacts 610*b* in the section between the forward edge of the base and the edge opposite the forward edge, as compared to the relatively inconsistent impedance along the same section of the electrical contacts 610*a* with the symmetrically arranged protrusions 630*a*, 635*a*. This in turn improves the high-frequency performance characteristics of the connector in which the electrical contacts 610*b* may be arranged in comparison to a connector using the electrical contacts 610*a* of FIG. 6A.

As noted above, symmetrical arrangement of protrusions may be desired to avoid twisting of electrical contacts. However, in this case, applicants have determined that other features of the electrical contacts 610*b* help to prevent twisting, thus allowing for the asymmetrical arrangement of the protrusions 630*b*, 635*b*.

Figure 7B:
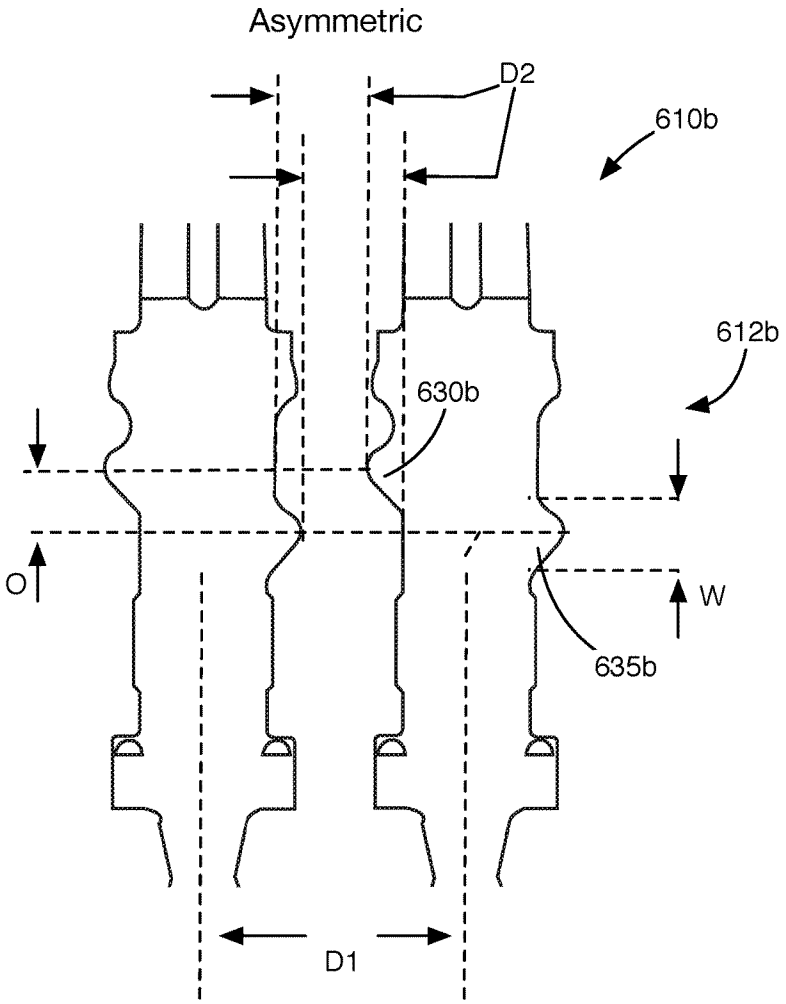
FIG. 7B illustrates details of the base sections of FIG. 6B.
Figure 7A:
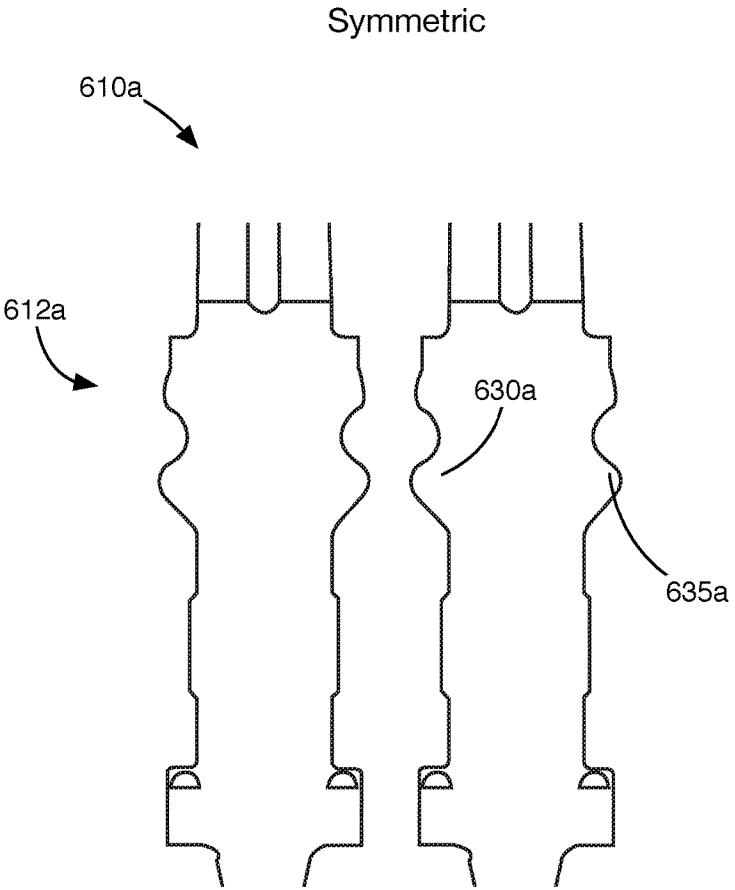
FIG. 7A illustrates details of the base sections of FIG. 6A.
Figure 8:
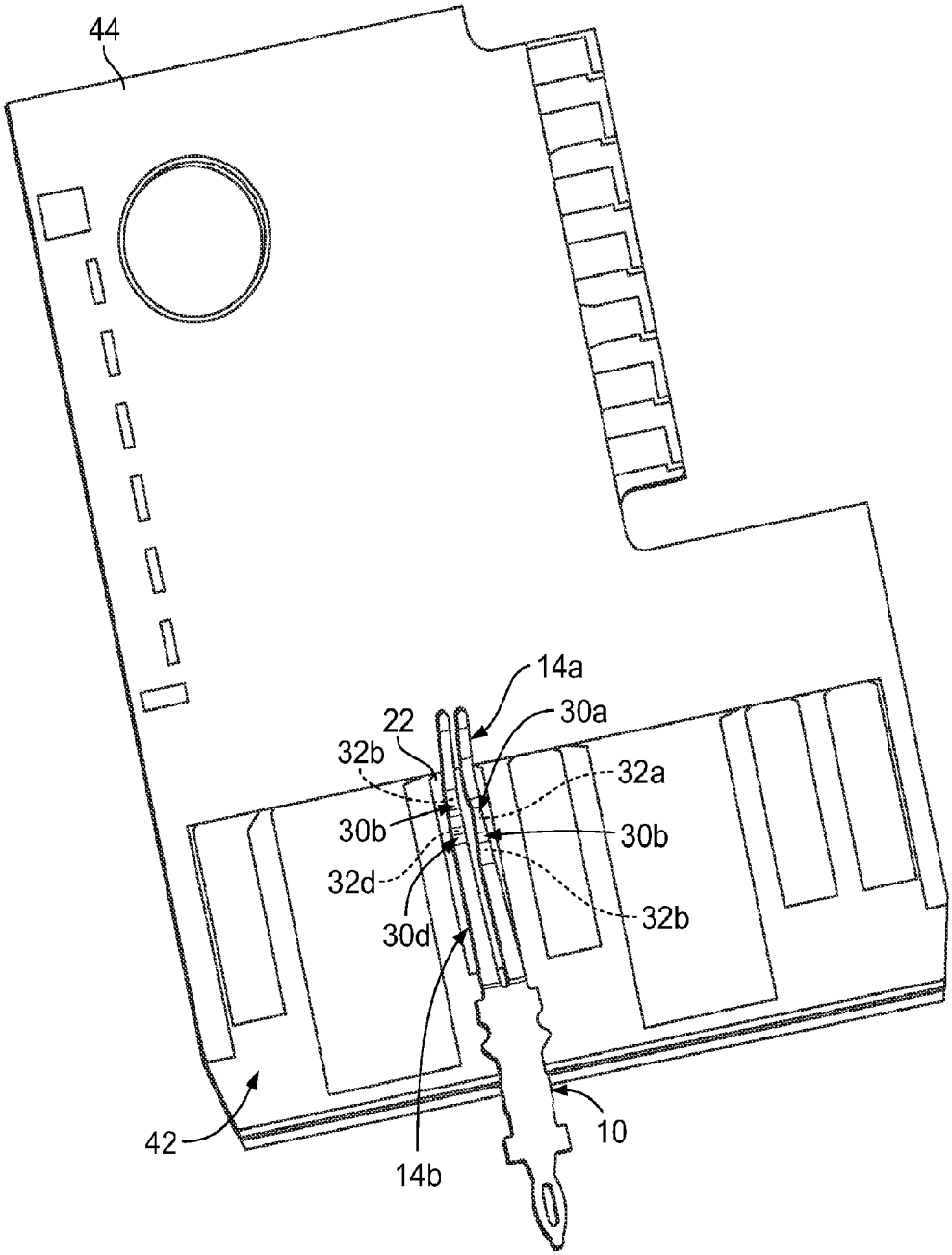
FIG. 8 is a plan view illustrating the electrical contact mated with a mating contact.

As more clearly shown in FIGS. 7A and 7B, in some implementations, the protrusions 630*b*, 635*b* of the electrical contact 610*b* may have a width W along a respective edge of about 0.5 mm and the center of the protrusion may be offset by a distance, O, from the center of a protrusion on the opposite edge by about 0.59 mm.

In an exemplary implementation, where the ideal impedance is about 100 ohms, when a first electrical contact 610*b* is arranged adjacent to a second electrical contact 610*b*, such that a distance D1 between respective center axis of the respective bases sections is about 1.8 mm, an impedance between the base of the first electrical contact 610*b* and the base of the second electrical contact 610*b* may be greater than about 96Ω. In this implementation, the distance, D2, between the first edge of the base 612*b* of the first electrical contact 610*b* and the second edge of the base 612*b* of the second electrical contact 610*b* may vary by less than 28%.

FIG. 8 is a plan view illustrating the electrical contact 10 mated with the mating contact 22. In the exemplary embodiment, the mating contact 22 is a contact pad that extends on a side 42 of the circuit board 44. In the exemplary embodiment, both of the arms 14*a* and 14*b* of the electrical contact 10 mate with the same mating contact 22. Alternatively, the arms 14*a* and 14*b* mate with different mating contacts.

The arms 14*a* and 14*b* are engaged with the mating contact 22. Specifically, the mating surfaces 32*a*, 32*b*, 32*c*, and 32*d* of the mating bumps 30*a*, 30*b*, 30*c*, and 30*d*, respectively, are each engaged with the mating contact 22. The engagement between the arms 14*a* and 14*b* and the mating contact 22 establishes an electrical connection between the electrical contact 10 and the mating contact 22. As can be seen in FIG. 8, each arm 14*a* and 14*b* includes two separate points of engagement with the mating contact 22. Specifically, the arm 14*a* include the mating surfaces 32*a* and 32*b*, while the arm 14*b* includes the mating surfaces 32*c* and 32*d*. The electrical contact 10 thus has four separate points of engagement with the mating contact 22 in the exemplary embodiment. It should be understood that each arm 14*a* and 14*b* may include any number of separate points of engagement with the mating contact 22, and that the electrical contact 10 may have any overall number of separate points of engagement with the mating contact 22. For example, in some embodiments, one or more of the arms 14 has three or more separate points of engagement with the mating contact 22.

The different axial locations of the mating bumps 30*a* and 30*b* of the arm 14*a* along the central longitudinal axis 16 may cause the mating bumps 30*a* and 30*b* to have different predetermined vibrational responses than each other. In other words, the mating bumps 30*a* and 30*b* may vibrate differently (e.g., at different frequencies and/or the like) than each other at the different corresponding points of engagement with the mating contact 22. For example, the mating bumps 30*a* and 30*b* may have different natural frequencies and/or may vibrate differently in response to a forced vibration exerted on the arm 14*a*. Similarly, the different axial locations of the mating bumps 30*e* and 30*d* of the arm 14*b* along the central longitudinal axis 16 may cause the mating bumps 30*c* and 30*d* to vibrate differently (e.g., at different frequencies and/or the like) than each other at the different corresponding points of engagement with the mating contact 22. For example, the mating bumps 30*c* and 30*d* may have different natural frequencies and/or may vibrate differently in response to a forced vibration exerted on the arm 14*b*. It should be understood that in embodiments wherein the arm 14*a* and/or the arm 14*b* includes more than two of the mating bumps 30, each mating bump 30 of each arm 14 may be provided with a different vibrational response than each other mating bump 30 of the same arm or at least one of the mating bumps 30 of an arm 14 may have the same vibrational response as at least one other mating bump 30 of the same arm 14.

Figure 9:
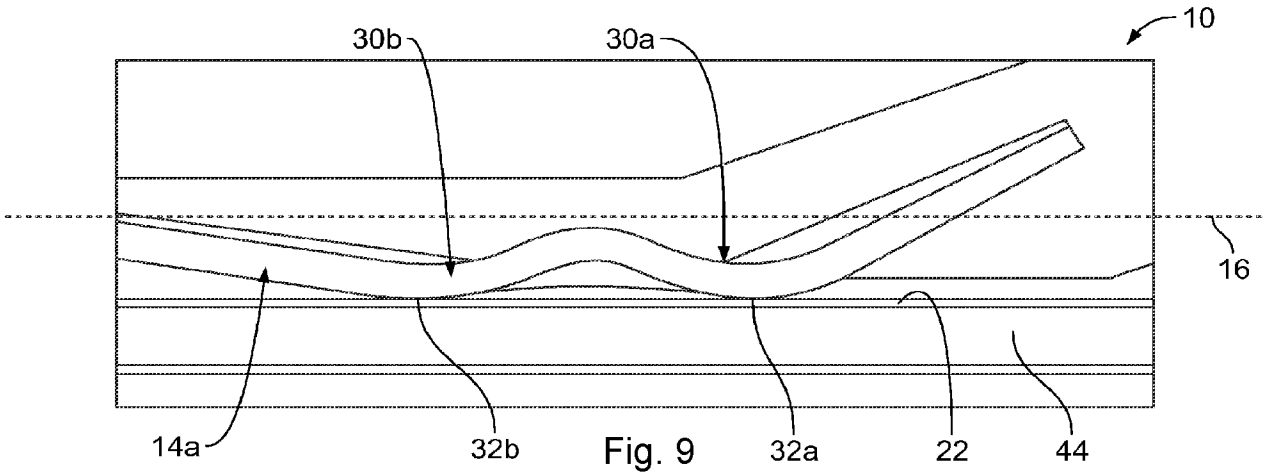
FIGS. 9 and 10 are a side elevational views illustrating the arm of the electrical contact mated with the mating contact.

FIG. 9 is a side elevational view illustrating the arm 14*a* of the electrical contact 10 mated with the mating contact 22. FIG. 9 illustrates the arm 14*a* in the deflected position. The mating surfaces 32*a* and 32*b* of the respective mating bumps 30*a* and 30*b* are engaged with the mating contact 22. The arm 14*a* has been deflected from the resting position shown in FIGS. 1-4 to the deflected position shown in FIGS. 6 and 7. The mating surfaces 32*a* and 32*b* lie within a plane that extends approximately parallel to the central longitudinal axis 16. In other words, the mating surfaces 32*a* and 32*b* are offset from the central longitudinal axis 16 by approximately the same amount, which may be zero (i.e., no offset) or may be an offset of any amount.

Figure 10:
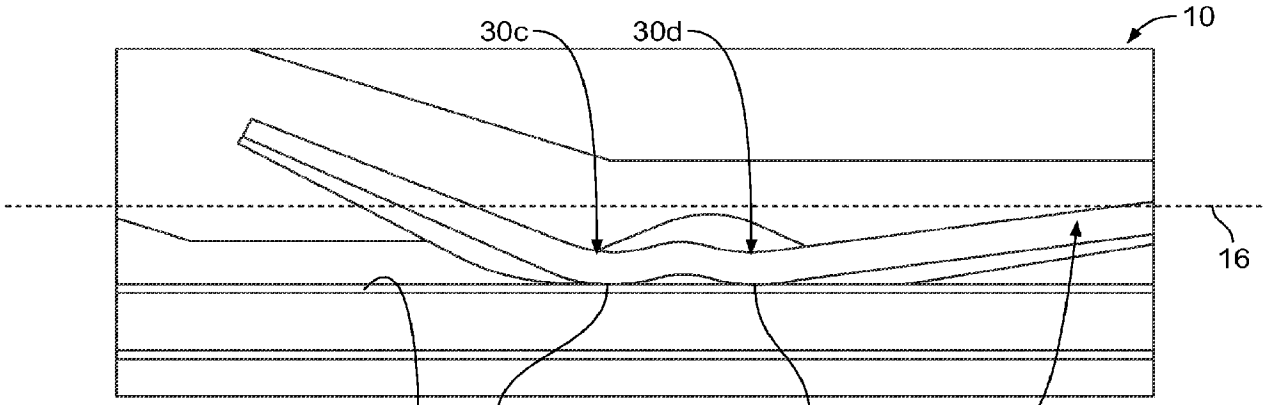

FIG. 10 is a side elevational view illustrating the arm 14*b* of the electrical contact 10 mated with the mating contact 22. The arm 14*b* is shown in the deflected position in FIG. 10. The mating surfaces 32*e* and 32*d* of the respective mating bumps 30*e* and 30*d* are engaged with the mating contact 22. The arm 14*b* has been deflected from the resting position shown in FIGS. 1, 2, 4, and 5 to the deflected position shown in FIGS. 6 and 8. The mating surfaces 32*e* and 32*d* lie within a plane that extends approximately parallel to the central longitudinal axis 16. In other words, the mating surfaces 32*e* and 32*d* are offset from the central longitudinal axis 16 by approximately the same amount, which may be zero (i.e., no offset) or may be an offset of any amount.

Referring again to FIG. 8, by providing at least two separate points of engagement with the mating contact 22 at each arm 14 (i.e., the mating surfaces 32*a* and 32*b* of the arm 14*a*) and the mating surfaces 32*c* and 32*d* of the arm 14*b*), each arm 14, and thus the electrical contact 10, may be less likely to be electrically disconnected from the mating contact 22 because of wear to the mating contact 22 and/or wear to the electrical contact 10. For example, because the two mating surfaces 32 of the same arm 14 are spaced apart from each other, the two mating surfaces 32 may not cause wear to the mating contact 22 and/or to the electrical contact 10 at the same rate as each other. Accordingly, if a first of the mating surfaces 32 of an arm 14 has worn the mating contact 22 such that the arm 14 no longer makes an adequate or any electrical connection with the mating contact 22 at the first mating surface 32, the second mating surface 32 of the arm 14 may have caused less or no wear to the mating contact 22 such that the arm 14 is adequately electrically connected to the mating contact 22 at the second mating surface. The difference in the wear rates caused by the two mating surfaces 32 of the same arm 14 may be a result, for example, of the different predetermined vibrational responses of the two mating bumps 30 of the same arm 14.

The redundant electrical connection provided by the two mating surfaces of an arm 14 may facilitate preventing or reducing data loss caused by wear to the electrical contact 10 and/or the mating contact 22 such as, but not limited to, wear caused by contact fretting and/or the like. For example, the redundant electrical connection provided by the two arms 14 may facilitate preventing or reducing data transmission errors. The electrical contact 10 may thus be adapted for relatively high-speed data connections such as, but not limited to, data speeds of at least approximately 5 gigabaud (G-baud).

In addition or alternatively to providing two or more different wear rates, providing the at least two separate points of engagement with the mating contact 22 may reduce the force exerted on the mating contact 22 by the arm 14 at any single point of engagement with the mating contact 22. In other words, the force exerted on the mating contact 22 at each of the mating surfaces 32 of the same arm 14 may be less than if the arm 14 only engaged the mating contact 22 at a single point. Such a reduction in the force exerted on the mating contact 22 at any single point of engagement may reduce the amount of wear at such a single point of engagement, which may facilitate preventing the arm 14 from being electrically disconnected from the mating contact 22 because of wear to the mating contact 22. In addition or alternatively, such a reduction in the force exerted on the mating contact 22 at any single point of engagement (and/or the different axial locations of the mating bumps 30) may reduce the insertion and/or extraction force required to mate the electrical contact 10 with the mating contact 22, which may eliminate or reduce damage to the electrical contact 10 and/or the mating contact 22 as the contacts 10 and 22 are mated together.

Moreover, providing two or more different wear rates may facilitate preventing a higher resistance connection between the electrical contact 10 and the mating contact 22 that is caused by wear to the electrical contact 10 and/or the mating contact 22. For example, providing two or more different wear rates may reduce the amount of wear to an electrically conductive surface coating (e.g., a plating and/or the like) that extends on the mating contact 22 and/or the arm 14. Reducing the amount of wear to the coating(s) may prevent the coating(s) from being worn through. If the coating(s) is worn through, engagement with a base material of the mating contact 22 and/or the electrical contact 10 may increase the resistance of the electrical connection between the mating contact 22 and/or the electrical contact 10 above a desired level. Accordingly, by reducing the amount of wear to an electrically conductive coating that extends on the mating contact 22 and/or the arm 14, the at least two separate points of engagement between the arm 14 and the mating contact 22 may prevent the connection between the electrical contact 10 and the mating contact 22 from having a higher resistance than is desired.

The different predetermined vibrational responses of the arms 14*a* and 14*b* may facilitate preventing the electrical contact 10 from being electrically disconnected from the mating contact 22 because of wear to the mating contact 22. For example, the different predetermined vibrational responses of the arms 14*a* and 14*b* may cause wear to the mating contact 22 at the different rates. Accordingly, even if a first of the arms 14 of the electrical contact 10 has worn the mating contact 22 such that the first arm 14 no longer makes adequate or any electrically connected to the mating contact 22, the second arm 14 may have caused less or no wear to the mating contact 22 such that the second arm 14, and thus the electrical contact 10, remains adequately electrically connected to the mating contact 22. The different predetermined vibrational responses of the arms 14*a* and 14*b* may thus enable one of the arms 14 to provide a backup that maintains the electrical connection with the mating contact 22 upon electrical failure or a reduced quality of electrical connection of the other arm 14. The redundant electrical connection provided by the two arms 14 may facilitate preventing or reducing data loss caused by wear to the electrical contact 10 and/or the mating contact 22 such as, but not limited to, wear caused by contact fretting and/or the like. For example, the redundant electrical connection provided by the two arms 14 may facilitate preventing or reducing data transmission errors. The electrical contact 10 may thus be adapted for relatively high-speed data connections.

Although shown and described herein with respect to a contact pad of a circuit board, it should be understood that the electrical contact 10 may be used with mating contacts having other structures such as, but not limited to, a blade, a bar, an arm, a spring, and/or the like. The embodiments of the electrical contact 10 shown and/or described herein may be used to facilitate preventing the electrical contact 10 from being electrically disconnected from such other mating contact structures because of wear to the mating contact in a substantially similar manner to that described and/or illustrated herein with respect to the mating contact 22. Moreover, in a substantially similar manner to that described and/or illustrated herein with respect to the mating contact 22, the embodiments of the electrical contact 10 shown and/or described herein may be used to facilitate preventing a higher resistance connection between the electrical contact 10 and such other mating contact structures caused by wear to the electrical contact 10 and/or the mating contact.

FIG. 9 is a partially exploded perspective view of an exemplary embodiment of an electrical connector assembly 100 with which the electrical contact 10 may be used. The electrical connector assembly 100 is meant as exemplary only. The electrical contact 10 is not limited to being used with the type of electrical connector assembly shown in FIG. 11. Rather, the electrical contact 10 may be used with electrical connector assemblies of other types and/or having other structures.

The electrical connector assembly 100 includes an electrical connector 102 and a mating connector 104. The connectors 102 and 104 are complementary such that the connectors 102 and 104 are configured to mate together to establish an electrical connection therebetween. In the exemplary embodiment, the electrical connectors 102 and 104 are configured to be mounted on circuit boards (not shown).

The mating connector 104 includes a housing 106 and a plurality of the circuit boards 44 held by the housing 106. The circuit boards 44 include a plurality of the mating contacts 22 (FIGS. 6-S). The electrical connector 102 includes a housing 105 having a plurality of contact cavities 110. The contact cavities 110 hold electrical contacts 10. The electrical contacts 10 are configured to mate with the mating contacts 22 to establish an electrical connection between tile electrical connector 102 and the mating connector 104.

The embodiments described and/or illustrated herein may provide an electrical contact that is less likely to be electrically disconnected from a mating contact because of wear to the mating contact. The embodiments described and/or illustrated herein may provide an electrical contact that experiences less wear and/or causes less wear to a mating contact with which the electrical contact mates. For example, the embodiments described and/or illustrated herein may provide an electrical contact that reduces or eliminates wear caused by contact fretting. The embodiments described and/or illustrated herein may provide an electrical contact that prevents or reduces data loss caused by wear to the electrical contact and/or a mating contact with which the electrical contact mates. The embodiments described and/or illustrated herein may provide an electrical contact that provides a reliable and relatively high-speed data connection in relatively rugged environments. The embodiments described and/or illustrated herein may provide an electrical contact having a reduced insertion and/or extraction force. The embodiments described and/or illustrated herein may provide an electrical contact that causes less or no damage to a mating contact and/or the electrical contact as the mating contact and electrical contact are mated together.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc., are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc., are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

We claim:

1. A pair of electrical contacts, each electrical contact comprising:

a base that includes first and second side edges, and a forward edge that extends between the first and second side edges; and at least one contact arm extending from the forward edge of the base for making electrical contact with a contact pad disposed on a printed circuit board;

a first protrusion pair and a second protrusion pair arranged on the base configured to engage an interior portion of a connector housing for securing the electrical contact within the connector housing, wherein a first protrusion of the first protrusion pair is arranged on the first side edge of the base and is asymmetrically positioned with respect to a second protrusion of the first protrusion pair that is arranged on the second side edge of the base such that respective centers of each protrusion of the first protrusion pair are misaligned along a longitudinal axis of the base, and wherein the protrusions of the second protrusion pair are symmetrically arranged on the base along the longitudinal axis of the base, wherein asymmetrical positioning of the of the first protrusion pair increases the impedance between the pair of electrical contacts to thereby improve high-frequency characteristics of the pair of electrical contacts.

2. The pair of the electrical contacts according to claim 1, wherein each of the one or more protrusions has a width along a respective edge of about 0.5 mm, wherein respective centers of each of the one or more protrusions on the first side edge are misaligned with respective centers of each of the one or more protrusions on the second side edge by a distance of at least 0.59 mm to thereby provide more uniform spacing between the pair of electrical contacts and improve the high-frequency characteristics of the pair of electrical contacts.

3. The pair of the electrical contacts according to claim 1, wherein when the first electrical contact is arranged adjacent to a second electrical contact such that a distance between respective center axis of the respective bases is about 1.8 mm, an impedance between the base of the first connector and the base of the second connector is greater than about 96Ω to thereby improve the high-frequency characteristics of the pair of electrical contacts.

4. The pair of the electrical contacts according to claim 1, wherein when the pair of electrical contacts are arranged such that a distance between respective center axis of the respective bases is about 1.8 mm, a distance between a side edge of the base of the first electrical connector and a side edge of the base of the second electrical connector that is adjacent to the side of the base of the first electrical connector varies by less than 28% to thereby provide more uniform spacing between the pair of electrical contacts and improve the high-frequency characteristics of the pair of electrical contacts.

5. An electrical connector assembly comprising:

a first connector; and a second connector configured to be mated to the first connector, wherein the second connector includes a plurality of electrical contacts, wherein an adjacent pair of the electrical contacts include:

a base that includes first and second side edges, and a forward edge that extends between the first and second side edges; and at least one contact arm extending from the forward edge of the base for making electrical contact with a contact pad;

a first protrusion pair and a second protrusion pair arranged on the base configured to engage an interior portion of a connector housing for securing the electrical contact within the connector housing, wherein a first protrusion of the first protrusion pair on the first side edge of the base and is asymmetrically positioned with respect to a second protrusion of the first protrusion pair that is arranged on the second side edge of the base such that respective centers of each protrusion of the first protrusion pair are misaligned along a longitudinal axis of the base, and wherein the protrusions of the second protrusion pair are symmetrically arranged on the base along the longitudinal axis of the base, wherein asymmetrical positioning of the of the first protrusion pair increases the impedance between the adjacent pair of electrical contacts to thereby improve high-frequency characteristics of the pair of electrical contacts.

6. The electrical connector assembly according to claim 5, wherein each of the one or more protrusions has a width along a respective edge of about 0.5 mm, wherein respective centers of each of the one or more protrusions on the first side edge are misaligned with respective centers of each of the one or more protrusions on the second side edge by a distance of at least 0.59 mm to thereby provide more uniform spacing between the pair of electrical contacts and improve the high-frequency characteristics of the pair of electrical contacts.

7. The electrical connector assembly according to claim 5, wherein when the first electrical contact is arranged adjacent to a second electrical contact such that a distance between respective center axis of the respective bases is about 1.8 mm, an impedance between the base of the first connector and the base of the second connector is greater than about 96Ω to thereby improve the high-frequency characteristics of the pair of electrical contacts.

8. The electrical connector assembly according to claim 5, wherein when the pair of electrical contacts are arranged such that a distance between respective center axis of the respective bases is about 1.8 mm, a distance between a side edge of the base of the first electrical connector and a side edge of the base of the second electrical connector that is adjacent to the side of the base of the first electrical connector varies by less than 28% to thereby provide more uniform spacing between the pair of electrical contacts and improve the high-frequency characteristics of the pair of electrical contacts.

9. A product that comprises:

a housing; and an electrical connector assembly disposed within the housing, the electrical connector assembly comprising:

a first connector; and a second connector configured to be mated to the first connector, wherein the second connector includes a plurality of electrical contacts, wherein an adjacent pair of the electrical contacts include:

a base that includes first and second side edges, and a forward edge that extends between the first and second side edges; and at least one contact arm extending from the forward edge of the base for making electrical contact with a contact pad;

a first protrusion pair and a second protrusion pair arranged on the base configured to engage an interior portion of a connector housing for securing the electrical contact within the connector housing, wherein a first protrusion of the first protrusion pair on the first side edge of the base and is asymmetrically positioned with respect to a second protrusion of the first protrusion pair that is arranged on the second side edge of the base such that respective centers of each protrusion of the first protrusion pair are misaligned along a longitudinal axis of the base, and wherein the protrusions of the second protrusion pair are symmetrically arranged on the base along the longitudinal axis of the base, wherein asymmetrical positioning of the of the first protrusion pair increases the impedance between the adjacent pair of electrical contacts to thereby improve high-frequency characteristics of the pair of electrical contacts.

10. The product according to claim 9, wherein each of the one or more protrusions has a width along a respective edge of about 0.5 mm, wherein respective centers of each of the one or more protrusions on the first side edge are misaligned with respective centers of each of the one or more protrusions on the second side edge by a distance of at least 0.59 mm to thereby provide more uniform spacing between the pair of electrical contacts and improve the high-frequency characteristics of the pair of electrical contacts.

11. The product according to claim 9, wherein when the first electrical contact is arranged adjacent to a second electrical contact such that a distance between respective center axis of the respective bases is about 1.8 mm, an impedance between the base of the first connector and the base of the second connector is greater than about 96Ω to thereby improve the high-frequency characteristics of the pair of electrical contacts.

12. The product according to claim 9, wherein when the pair of electrical contacts are arranged such that a distance between respective center axis of the respective bases is about 1.8 mm, a distance between a side edge of the base of the first electrical connector and a side edge of the base of the second electrical connector that is adjacent to the side of the base of the first electrical connector varies by less than 28% to thereby provide more uniform spacing between the pair of electrical contacts and improve the high-frequency characteristics of the pair of electrical contacts.

* * * * *